US006817623B1

(12) United States Patent
Gerutto

(10) Patent No.: US 6,817,623 B1
(45) Date of Patent: Nov. 16, 2004

(54) CASE SYSTEM FOR ARTICLES AND METHOD OF USE

(76) Inventor: Mike Gerutto, 4321 Atlantic Ave., Long Beach, CA (US) 90807

( * ) Notice: Subject to any disclaimer, the term of this patent is extended or adjusted under 35 U.S.C. 154(b) by 0 days.

(21) Appl. No.: 10/242,873

(22) Filed: Sep. 16, 2002

(51) Int. Cl.[7] ..... B62B 1/00

(52) U.S. Cl. ..... 280/655.1; 280/37; 220/23.83; 190/108

(58) Field of Search ..... 280/37, 652, 655.1, 280/47.26; 220/23.83, 23.86; 224/581, 582, 583, 584, 585; 190/18 A, 108; D3/279

(56) References Cited

U.S. PATENT DOCUMENTS

| | | | | | |
|---|---|---|---|---|---|
| 1,149,266 | A | * | 8/1915 | Johnson | 280/37 |
| 3,891,230 | A | | 6/1975 | Mayer | |
| 4,118,048 | A | * | 10/1978 | Spranger et al. | 190/18 A X |
| 4,311,222 | A | * | 1/1982 | Castanier | 190/18 A |
| 4,538,709 | A | * | 9/1985 | Williams et al. | 190/18 A |
| D285,145 | S | * | 8/1986 | Hsieh | D3/279 |
| 5,219,423 | A | * | 6/1993 | Kamaya | 224/581 |
| 5,240,264 | A | | 8/1993 | Williams | |
| 5,445,397 | A | * | 8/1995 | Evans | 280/651 |
| 5,511,806 | A | * | 4/1996 | McNair | 280/47.2 |
| 5,513,066 | A | | 4/1996 | Berman | |
| 5,528,453 | A | | 6/1996 | Berman | |
| 5,664,652 | A | | 9/1997 | Shamah | |
| 6,024,194 | A | | 2/2000 | Chung-Hsien | |
| 6,176,559 | B1 | | 1/2001 | Tiramani | |
| 6,193,033 | B1 | * | 2/2001 | Sadow et al. | 190/18 A |
| 6,213,267 | B1 | * | 4/2001 | Miller | 190/108 |
| 6,347,847 | B1 | | 2/2002 | Tiramani | |
| 6,371,320 | B2 | * | 4/2002 | Sagol | 220/23.83 |

FOREIGN PATENT DOCUMENTS

| | | | |
|---|---|---|---|
| DE | 3121762 | * | 1/1983 |

* cited by examiner

*Primary Examiner*—Bryan Fischmann
(74) *Attorney, Agent, or Firm*—Timothy T. Tyson; Ted Masters; Freilich, Hornbaker & Rosen

(57) ABSTRACT

A case system and method includes a first case and a second case. The first case has wheels and an extendable handle having two handle shafts. The second case has two parallel grooves which receive the two handle shafts. The second case also has two latches which lock the two handle shafts in place within the two parallel grooves, so that the two case are secured together and may be wheeled about as a single unit. In a second embodiment of the invention, the first case has a top half and a bottom half, the top half being removable from the bottom half. When the bottom half is stacked on top of the top half, two cavities in the top half receive the two wheels of the bottom half so that the bottom half resides in a level orientation.

7 Claims, 11 Drawing Sheets

CASE SYSTEM FOR ARTICLES AND METHOD OF USE

TECHNICAL FIELD

The present invention pertains generally to cases and containers for storing and transporting various articles such as electronic equipment, and more particularly to a case system in which case components may be connected together.

BACKGROUND OF THE INVENTION

Containers and cases for transporting products are well known in the art. For example, U.S. Pat. No. 3,891,230 shows a wheeled cart in combination with a plurality of suitcases, vertically stacked thereon in a nested relationship. Clamp means lock the cart and suitcases together.

U.S. Pat. No. 5,240,264 illustrates a container for holding assorted items which includes a rack, a compartment having a rear face and connected to the rack, a flange member extending from the rack which can pivot flat against the rear face of the compartment, and a wheel mounted on the flange member which can pivot with the flange member against the rear face of the compartment, to conserve space and prevent unwanted rolling of the container. The compartment is preferably an elongated, hollow cube, and a plurality of such compartments may be provided, one on top of the other, for the segregated retention of items. The rack preferably includes an essentially inverted U-shaped tube having a cross segment and two parallel side segments. The compartment top and bottom faces have rack receiving ports for receiving the side segments of the rack. The side segments are each formed of multiple link portions removably connected together. A method of assembling a container as described above includes the steps of fitting the link portions together and into the cross segment, and sliding the assembled side segments through the compartment ports. A method of disassembling a container as described above includes the steps of sliding the side segments out of the compartment ports, and pulling the link portions of the side segments and the cross segment apart.

U.S. Pat. Nos. 5,513,066 and 5,528,453 disclose a recording equipment travel cart for easily transporting video recording equipment used in video depositions. The cart has at least two compartments. One compartment is detachable from the main compartment. Casters are provided for easily rolling and transporting the cart. A foam cushion in the interior protects the equipment.

U.S. Pat. No. 5,664,652 shows vertically expandable luggage having an integral wheeled carrier. The luggage has at least three vertically stacked shells defining: (i) a bottom shell with a closed bottom, (ii) a top shell with an openable closed top, and (iii) at least one vertically stacked intermediate shell connecting the top shell and the bottom shell. The vertically expandable wheeled carrier has at least three vertically stacked supports defining: (i) a bottom support of diameter D3, (ii) a top support of diameter D1, and (iii) a vertically stacked intermediate support of diameter D2 functionally connecting the top support and the bottom support. The intermediate support telescopically receives the top support and is telescopically received in the bottom support. The top support telescopically moves within the intermediate support without movement of the shells. The top portion of the intermediate support moves with the top shell, and the top portion of the bottom support moves with the bottom shell.

U.S. Pat. No. 6,024,194 describes a wheeled case for holding document file holders. The wheeled case has a substantially rectangular case body having a front opening, two front covers flexibly connected to the front opening for covering the front opening, two front cover fasteners installed over the two front covers for closing the front covers, and a pull handle assembly. The handle has two sliding tubes and a U-shaped pull handle vertically installed in the case body near the front opening. Two hanging rods are horizontally installed over the sliding tubes for hanging the document file holders.

U.S. Pat. No. 6,176,559 shows a rolling containers assembly having a base cabinet with wheels and a handle. At least one additional cabinet is removably connectable on top of the base cabinet.

U.S. Pat. No. 6,347,847 is directed to a rolling containers assembly having a base cabinet with wheels. At least one additional cabinet is removably connectable on top of the base cabinet and has a handle for moving the rolling containers assembly.

SUMMARY OF THE INVENTION

The present invention is directed to a transportation case system for articles and method of using same. Case system components cooperate to enhance case transportation and stacking. The case system comprises two equipment cases, such as for storing and transporting musical electronic equipment. The cases may be connected together in an over/under relationship for the purpose of wheeling the connected cases as a single unit.

The first, or bottom case, has two wheels along one edge and an extendable handle, which when extended exposes two handle shafts. The second, or top case, has two grooves which accept the two handle shafts. Latches on the second case selectively lock the handles shafts in place within the two grooves, thereby attaching the second case to the first case.

In an alternative embodiment, the bottom case has a top half which is removable from a bottom half. The top half has two cavities which are shaped and dimensioned to receive the wheels of the bottom half, so that the bottom half may be placed on top of the top half, wherein the bottom half is disposed in a level state.

Other features and advantages of the present invention will become apparent from the following detailed description, taken in conjunction with the accompanying drawings, which illustrate, by way of example, the principles of the invention.

DETAILED DESCRIPTION OF THE INVENTION

Figure 1:
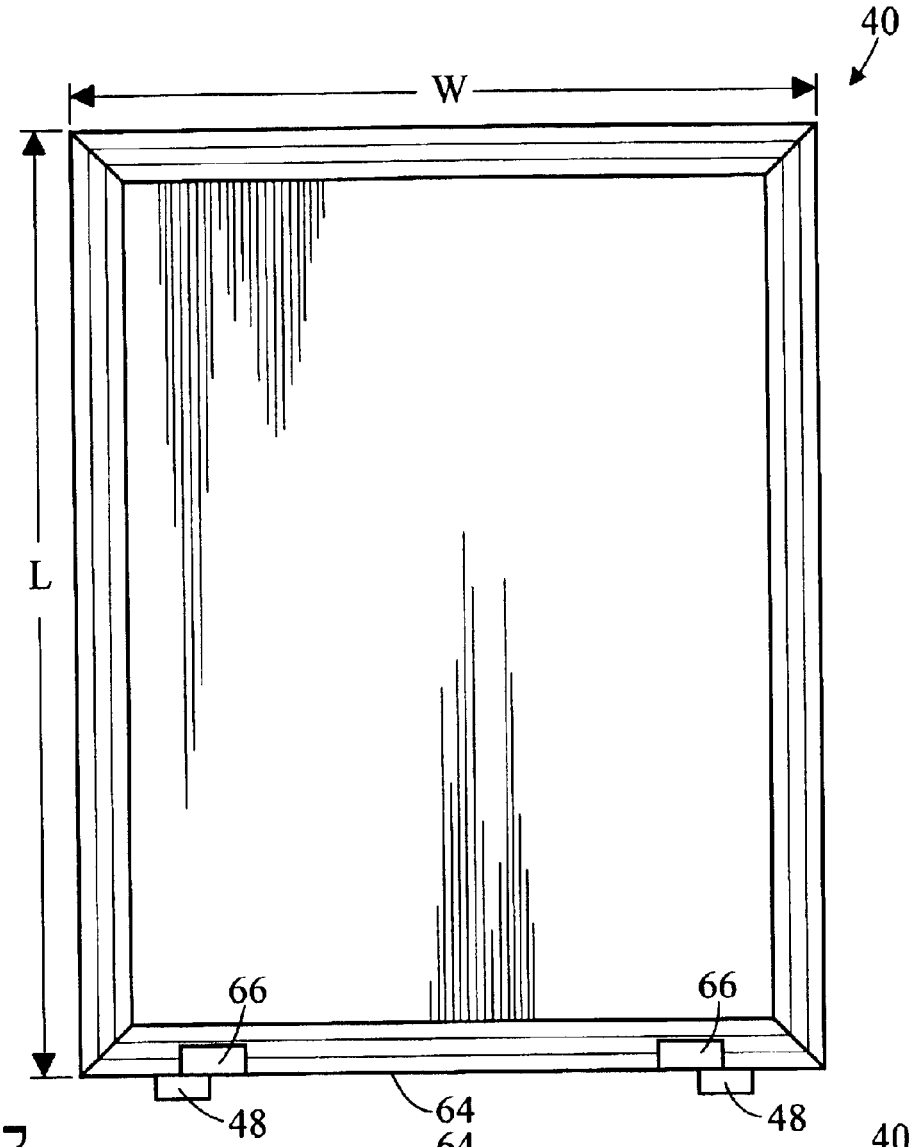
FIG. 1 is a top plan view of a first case in accordance with the present invention.
Figure 2:
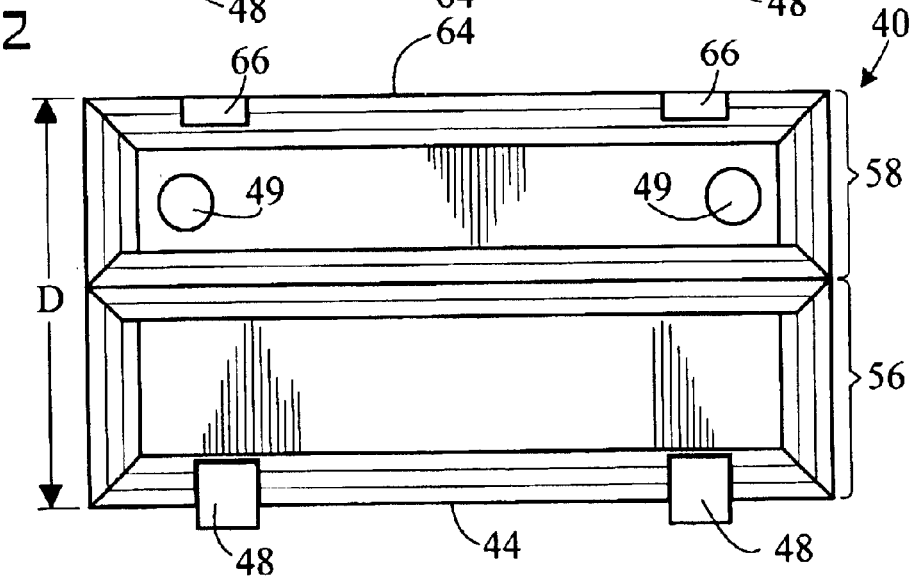
FIG. 2 is a first end elevation view of the first case.
Figure 3:
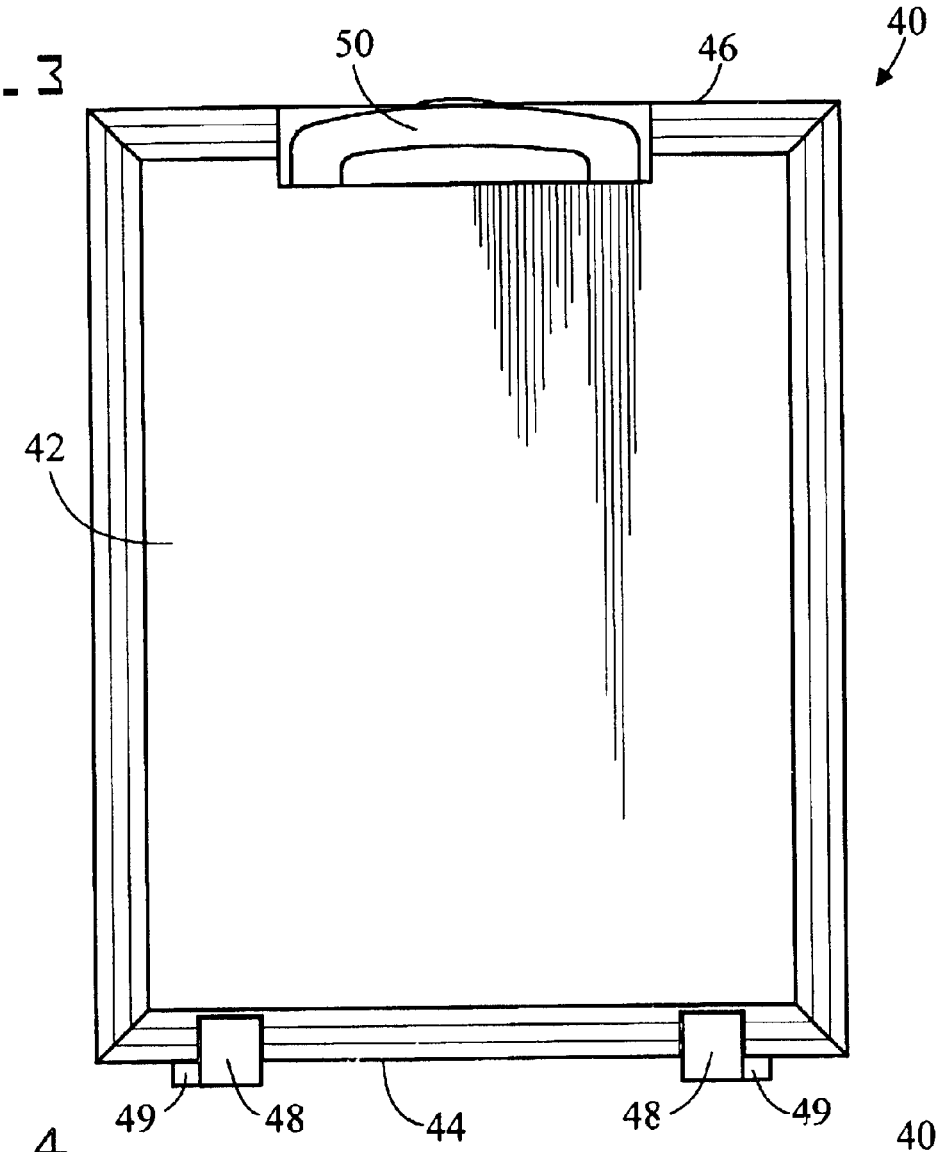
FIG. 3 is a bottom plan view of the first case.
Figure 4:
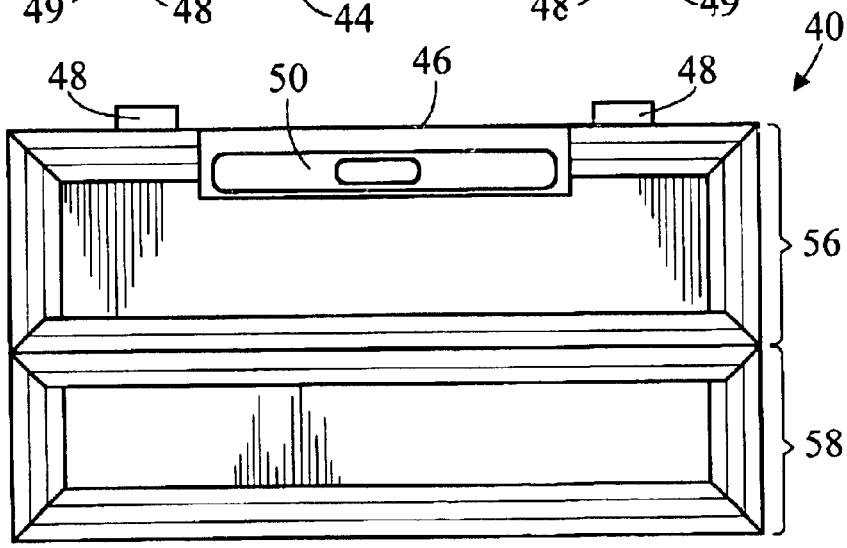
FIG. 4 is a second end elevation view of the first case.
Figure 5:
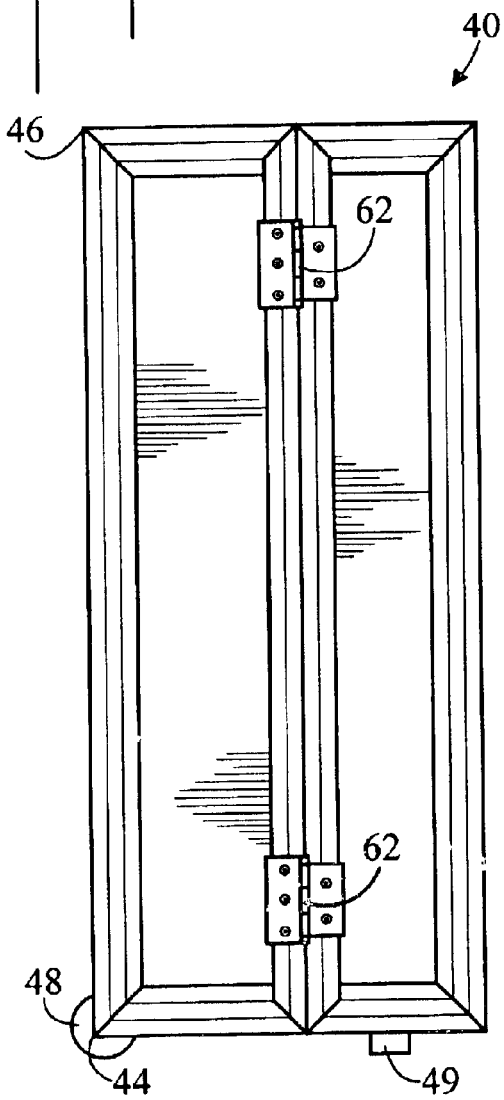
FIG. 5 is a first side elevation view of the first case.
Figure 6:
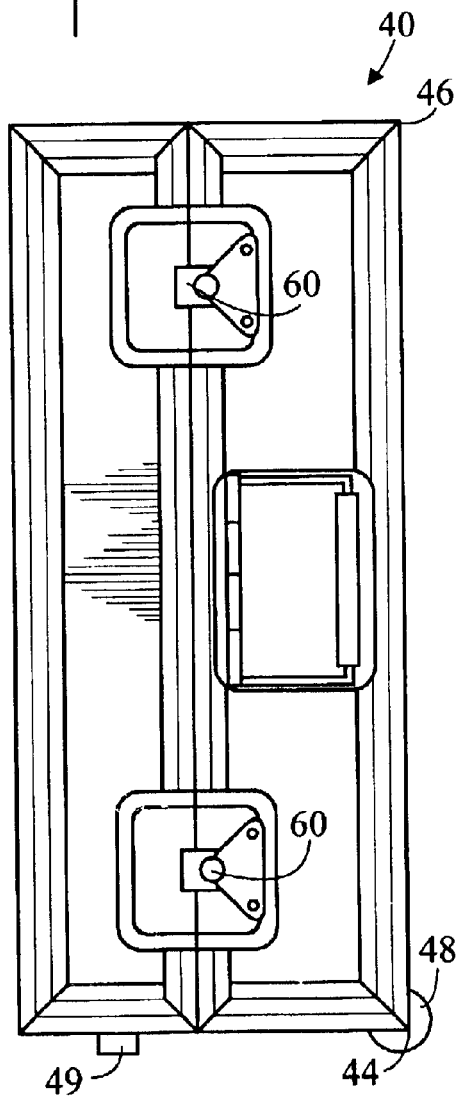
FIG. 6 is a second side elevation view of the first case.
Figure 7:
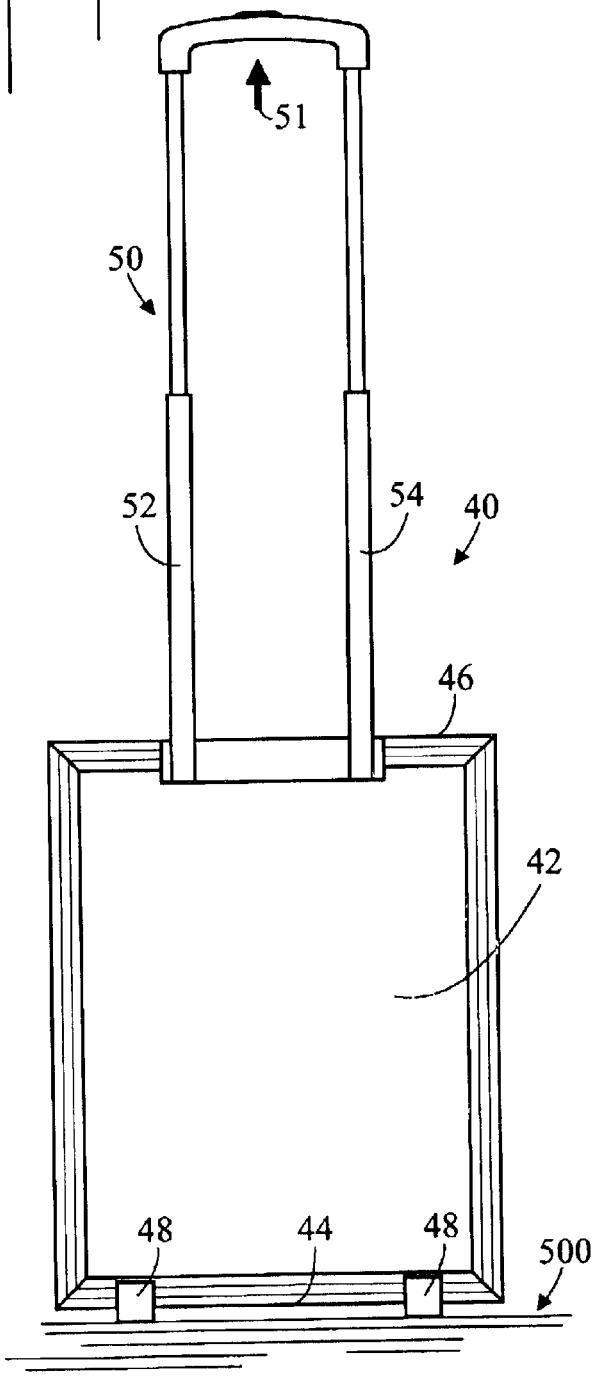
FIG. 7 is a reduced bottom plan view of the first case with a handle extended.
Figure 8:
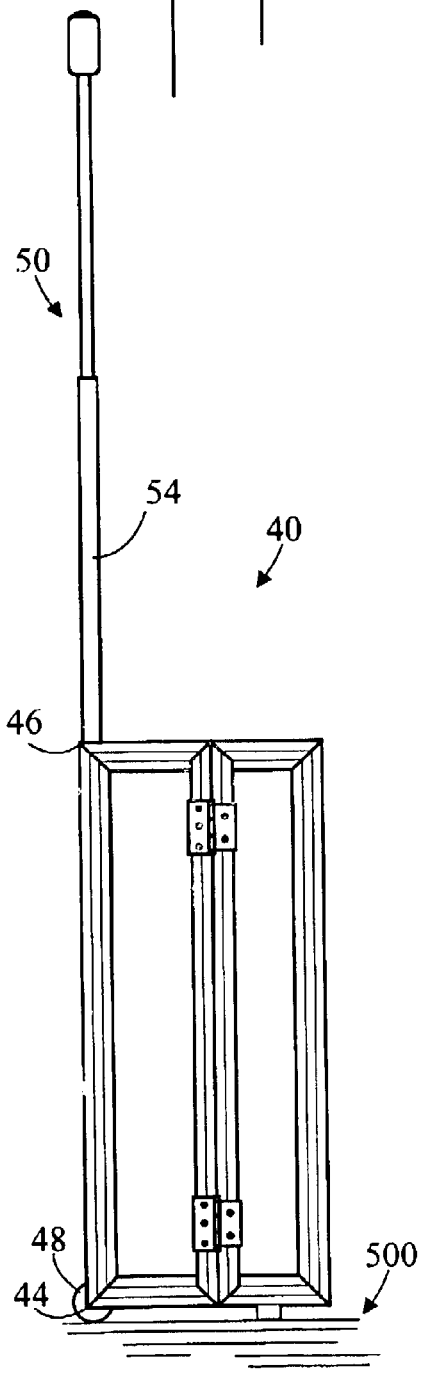
FIG. 8 is a reduced first side elevation view with the handle extended.
Figure 9:
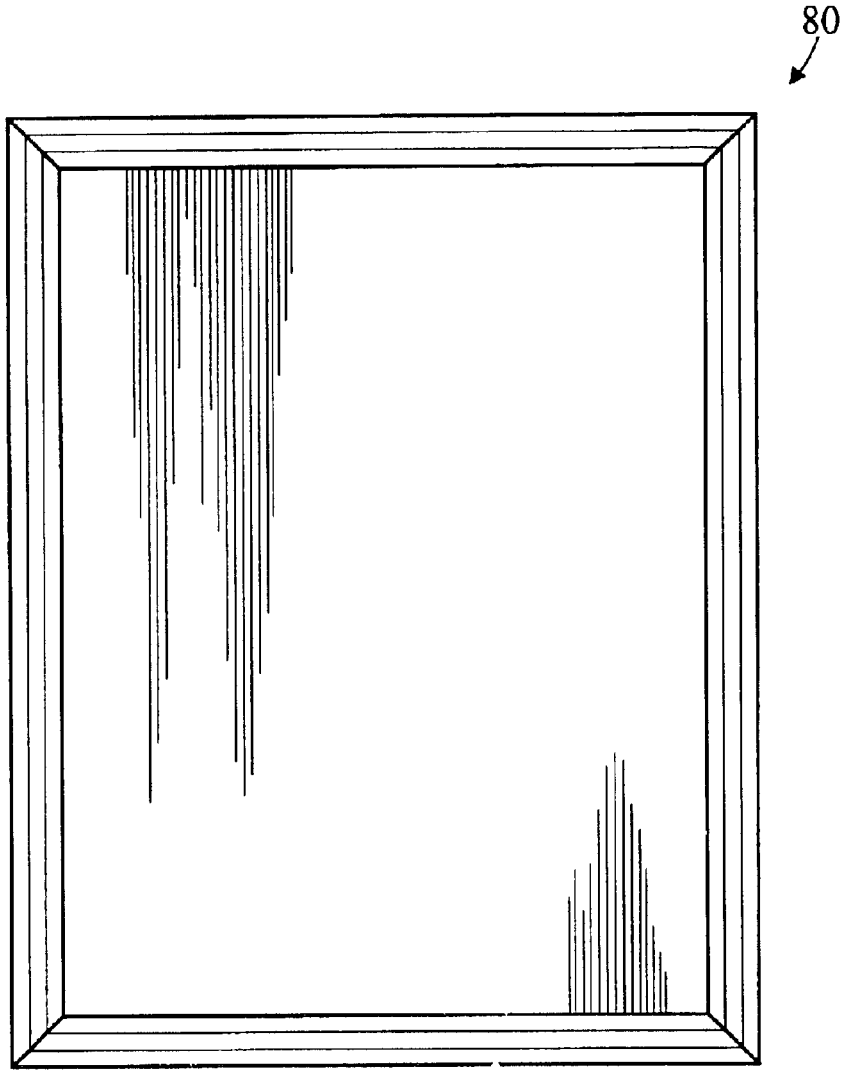
FIG. 9 is a top plan view of a second case in accordance with the present invention.
Figure 10:
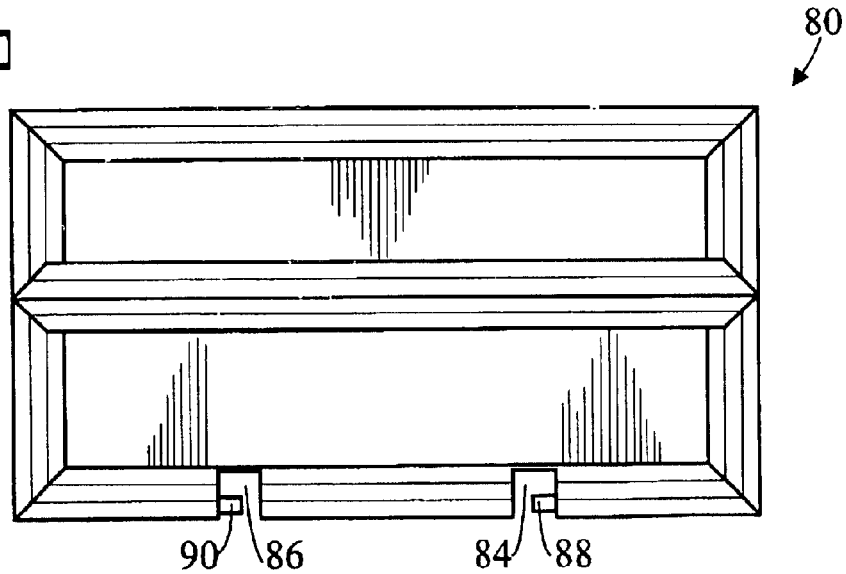
FIG. 10 is a first end elevation view of the second case.
Figure 11:
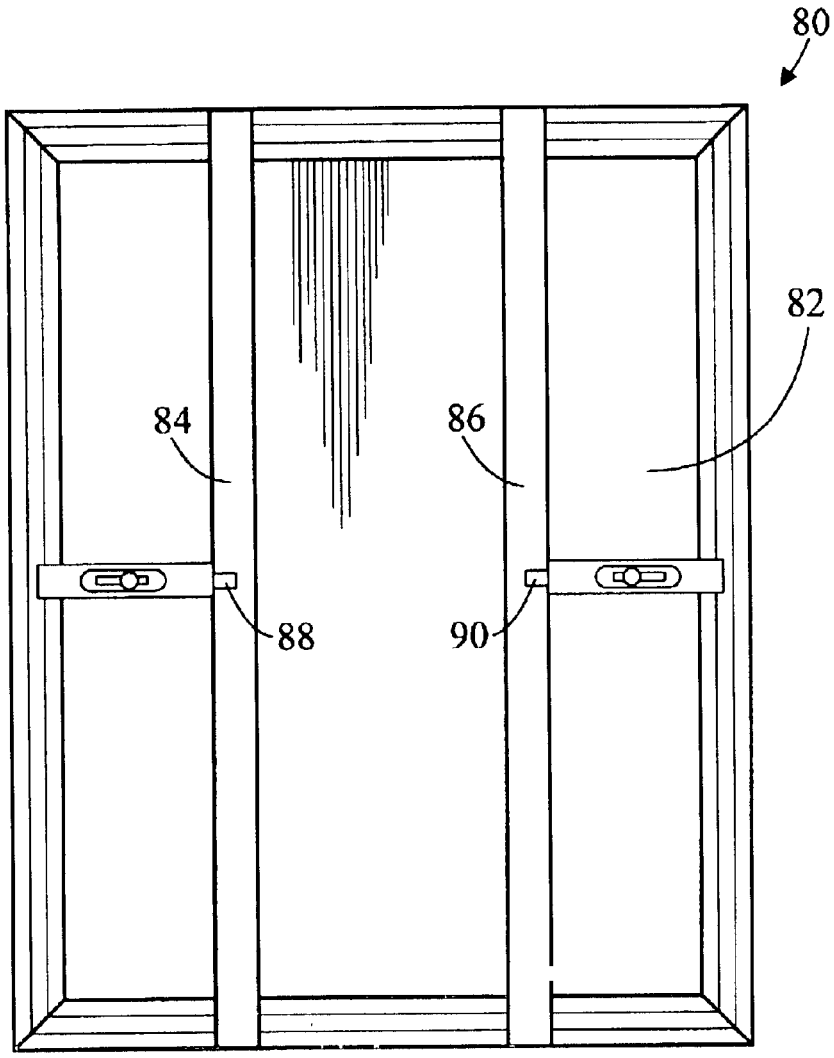
FIG. 11 is a bottom plan view of the second case.
Figure 12:
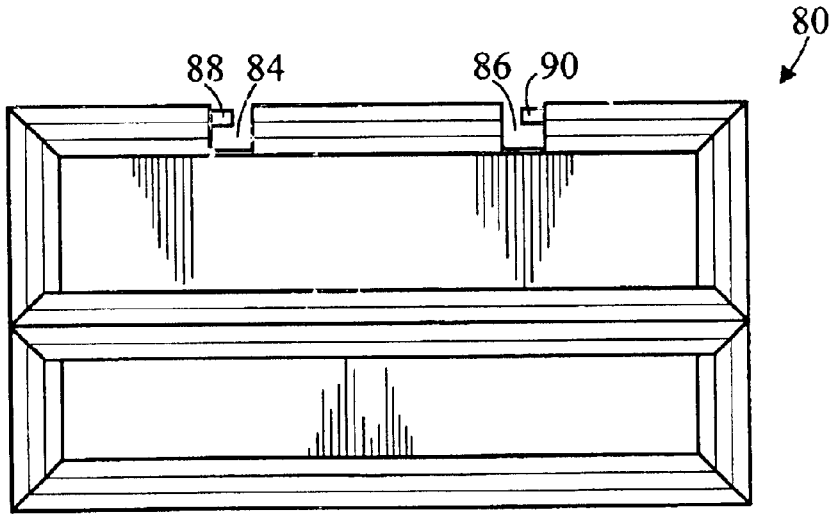
FIG. 12 is a second end elevation view of the second case.
Figure 13:
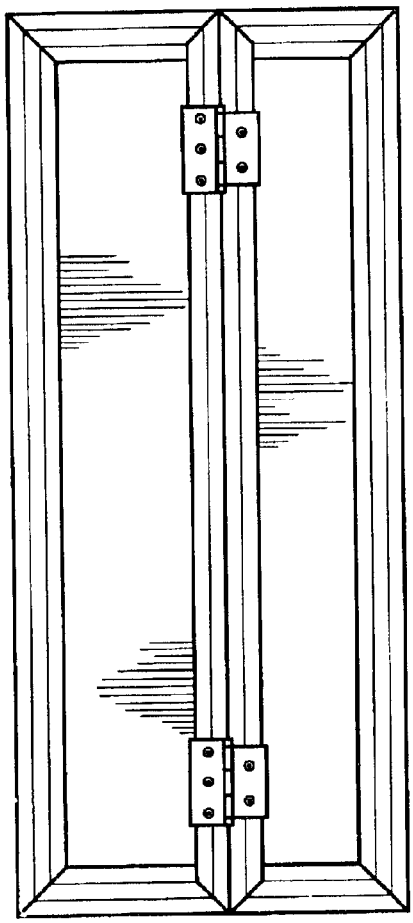
FIG. 13 is a first side elevation view of the second case.
Figure 14:
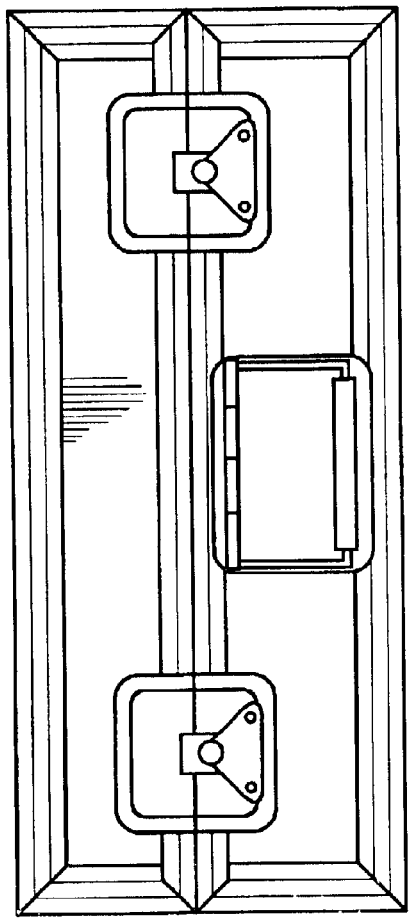
FIG. 14 is a second side elevation view of the second case.

Referring initially to FIGS. 1–8 there are illustrated top plan, first end elevation, bottom plan, second end elevation, first side elevation, second side elevation, reduced bottom plan with handle extended, and reduced first side elevation with handle extended, views, respectively, of a first case in accordance with the present invention, generally designated as 40. In a preferred embodiment, first case 40 has a rectangular shape in which length L is greater than width W which in turn is greater than depth D. However, it may be appreciated that other dimensional relationships could also apply. First case 40 includes a bottom 42 having a first edge 44 and an opposite second edge 46. In the shown preferred embodiments, edges 44 and 46 are oriented along width W. At least one wheel 48 is disposed along first edge 44. In the shown preferred embodiment, two spaced apart wheels 48 are utilized. Two rubber feet 49 permit first case 40 to stand upright on a support surface 500 (refer to FIG. 7). It may be noted that wheels 48 and feet 49 are disposed on first end of first case 40. A handle 50 is disposed along second edge 46, wherein handle 50 may be selectively pulled out in direction 51 from a retracted position to an extended position thereby exposing first and second handle shafts 52 and 54. In a preferred embodiment, handle shafts 52 and 54 are telescoping. It will be appreciated that there could be three or any other number of handle shafts.

First case 40 has a bottom portion 56 and a top portion 58 which is removable from bottom portion 56. The separation of top portion 58 from bottom portion 56 is effected by undoing latches 60 and rotating top portion 58 around separable hinges 62.

At least one wheel 48 is disposed on bottom portion 56. Top portion 58 has a third edge 64. At least one wheel-receiving cavity 66 is disposed along third edge 64. Wheel-receiving cavity 66 is shaped and dimensioned to receive wheel 48 so that bottom portion 56 may be levelly stacked on top of top portion 58 (refer also to FIGS. 20 and 21). In the shown preferred embodiment, two spaced apart cavities 66 receive two spaced apart wheels 48.

Now referring to FIGS. 9–14, there are illustrated top plan, first end elevation, bottom plan, second end elevation, first side elevation, and second side elevation views, respectively, of a second case in accordance with the present invention, generally designated as 80. In the shown preferred embodiment, second case 80 is the same size as first case 40. It will be appreciated that the cases do not have to be the same size. Second case 80 includes a bottom 82 having first 84 and second 86 spaced apart parallel grooves. Grooves 84 and 86 are shaped and dimensioned to longitudinally receive first 52 and second 54 handle shafts respectively of first case 40 (refer also to FIGS. 17 and 18). A first latch 88 may selectively be activated (extended into or across first groove 84) thereby capturing first handle shaft 52. A second latch 90 may selectively be activated (extended into or across second groove 86) thereby capturing second handle shaft 54 (refer also to FIG. 17).

Figure 15:
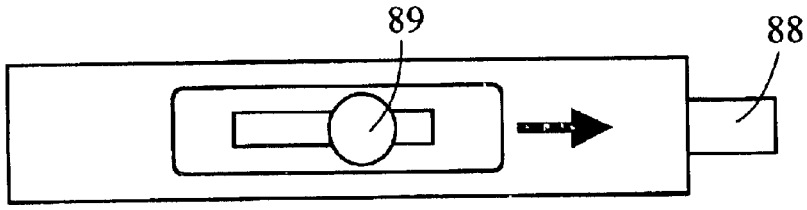
FIG. 15 is an enlarged view of a first latch in an extended position.
Figure 16:
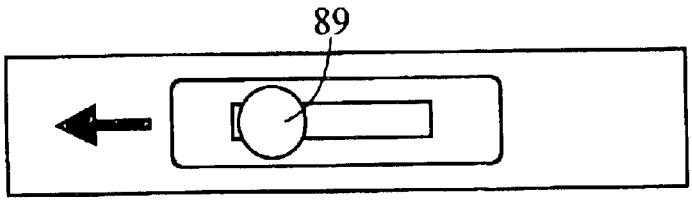
FIG. 16 is and enlarged view of the first latch in a retracted position.

FIGS. 15 and 16 are enlarged bottom plan views of first latch 88 shown in (1) an activated or extended position (extending into or across first groove 84), and (2) a retracted or not extended position (moved out of first groove 84), respectively. The operation (extension or retraction) is effected by knob 89. It will be appreciated that other types of locks may serve the same purpose. For example, a single handle might be used to move both locks.

Figure 17:
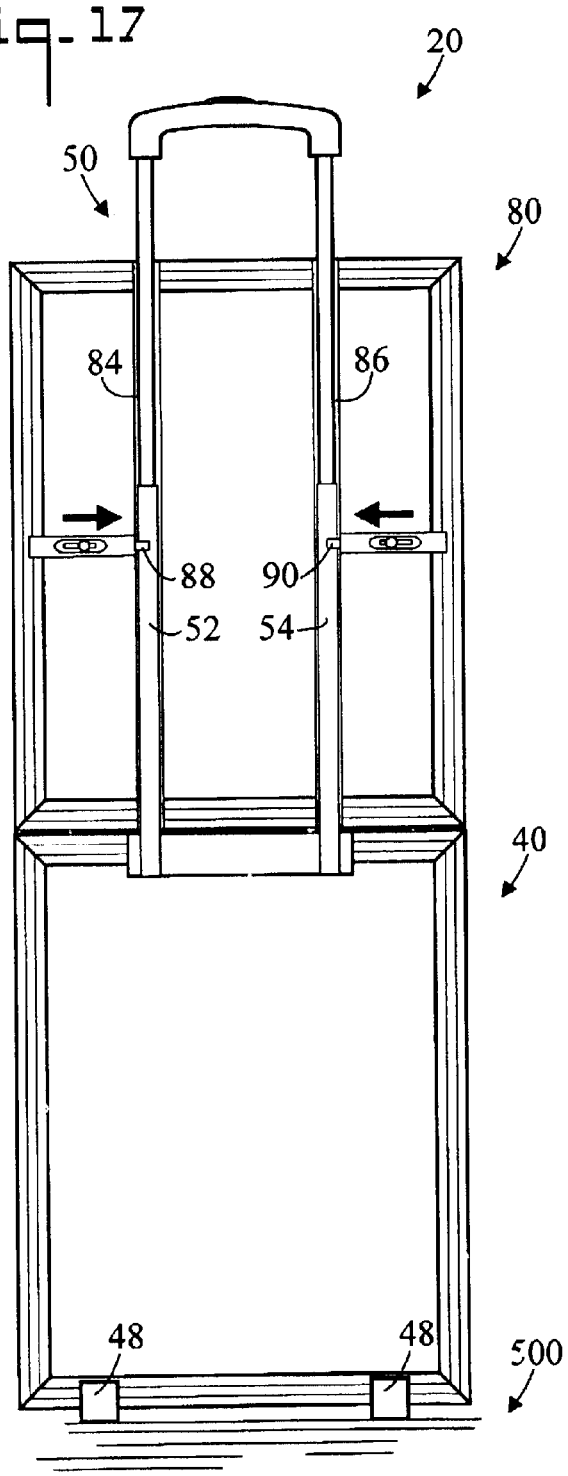
FIG. 17 is a reduced bottom plan view of a case system for articles in accordance with the present invention.
Figure 18:
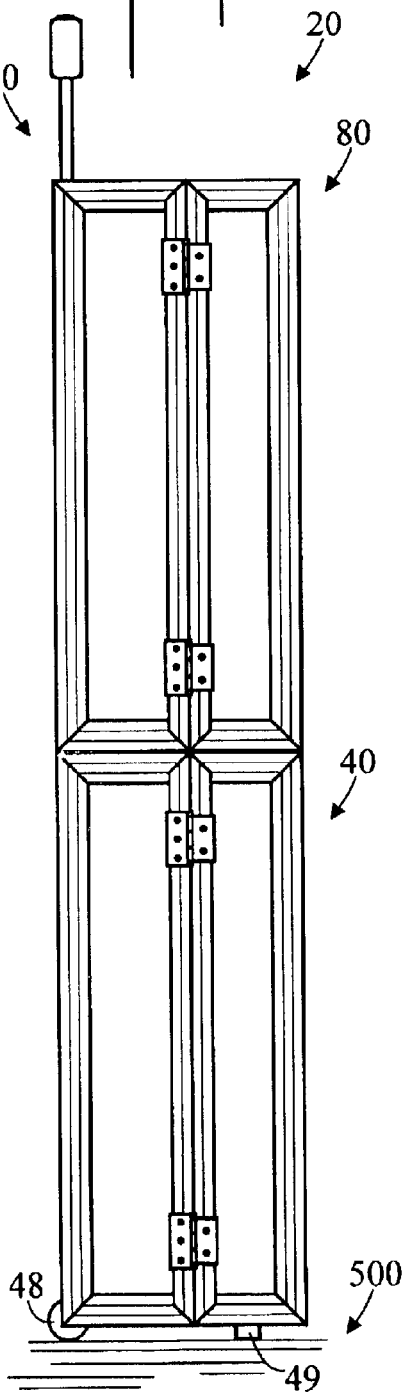
FIG. 18 is a reduced first side elevation view of the case system.

FIGS. 17 and 18 are reduced bottom plan and first side elevation views respectively of a case system for articles in accordance with the present invention, generally designated as 20. Second case 80 has been installed on first case 40. Handle 50 has been extended. First and second latches 88 and 90 have first been moved out of first and second grooves 84 and 86. Second case 80 is stacked on top of first case 40 so that first groove 84 receives first handle shaft 52, and second groove 86 receives second handle shaft 54. First and second latches 88 and 90 are then extended thereby capturing first 52 and second 54 handle shafts, and retaining second case 80 in fixed relationship with respect to first case 40.

Figure 19:
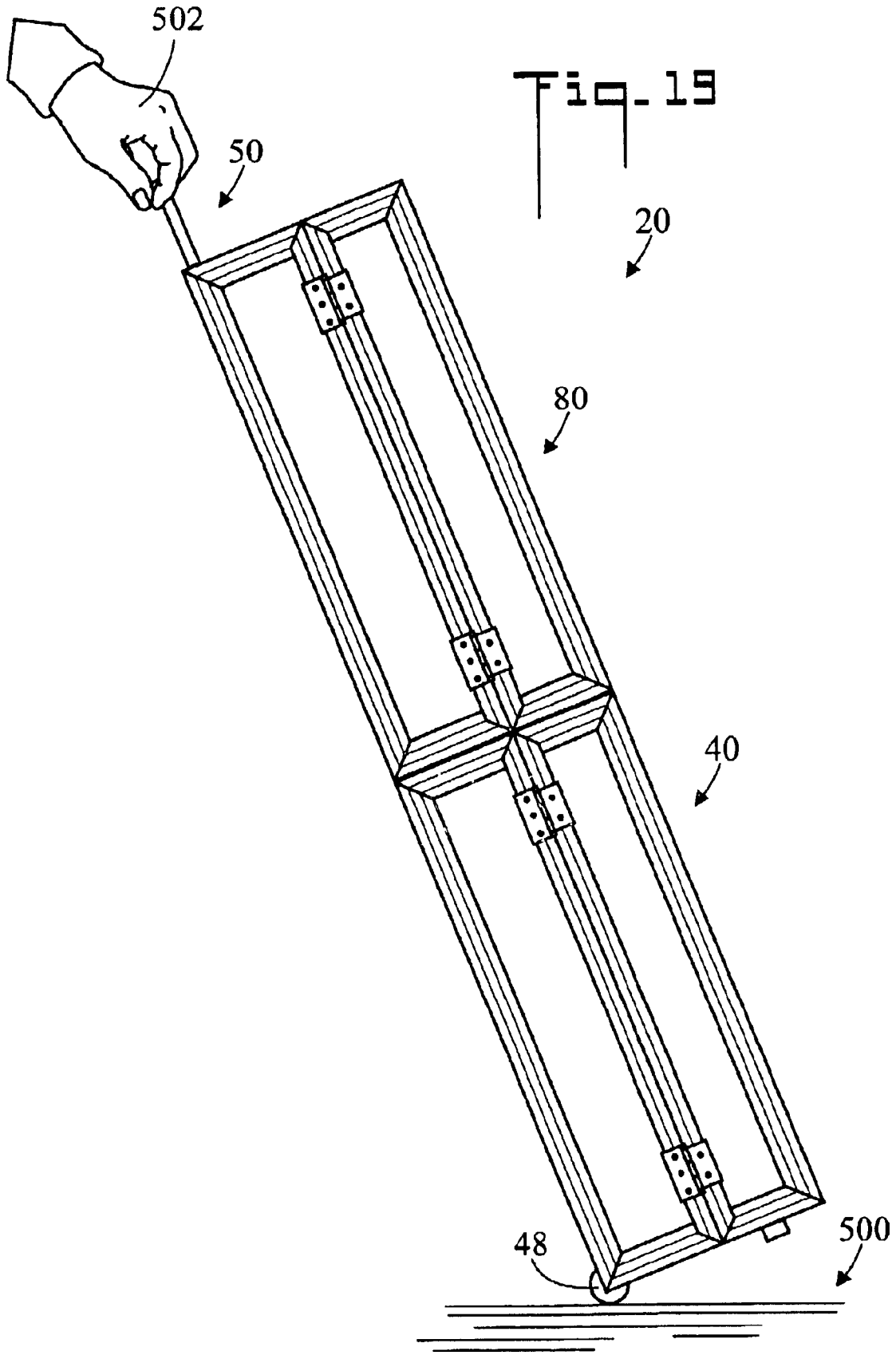
FIG. 19 is a reduced first side elevation view of the case system being pulled by a user.

FIG. 19 is a reduced first side elevation view of case system 20 being pulled by a user 502 by handle 50 on wheels 48 along a support surface 500.

Figure 20:
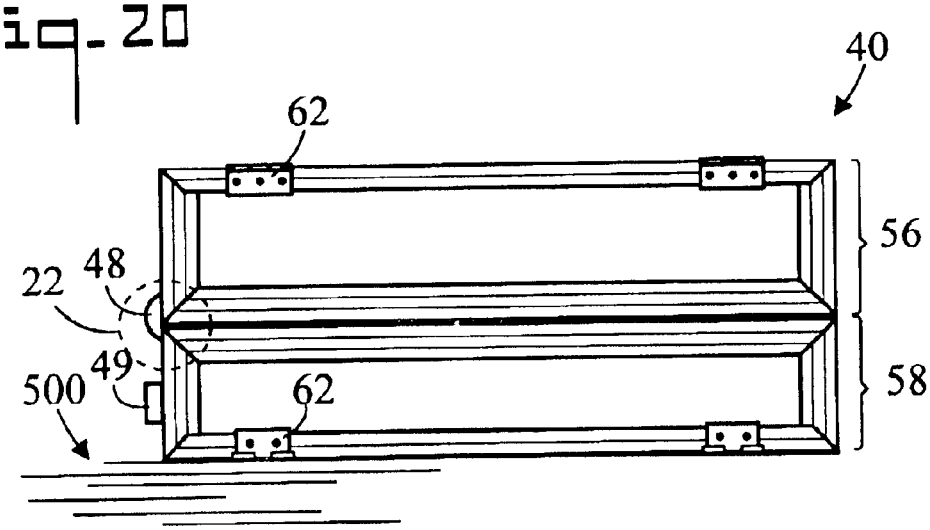
FIG. 20 is a reduced first side elevation view of the first case in an alternate configuration.
Figure 21:
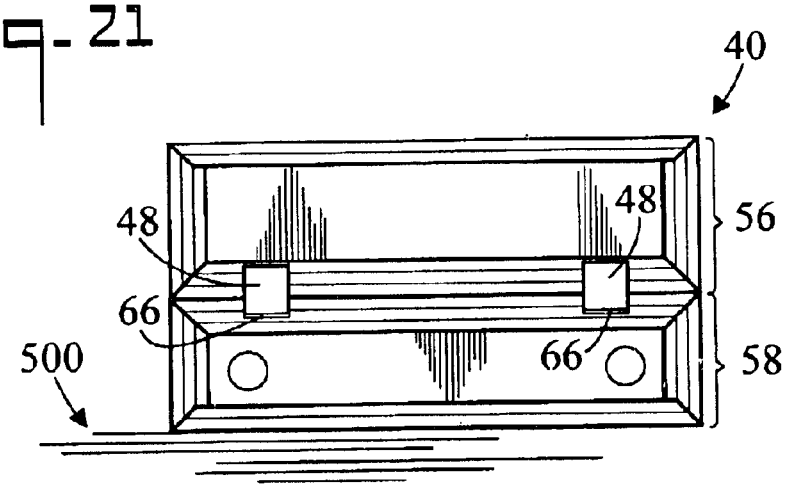
FIG. 21 is a reduced first end elevation view of the first case in the alternate configuration.
Figure 22:
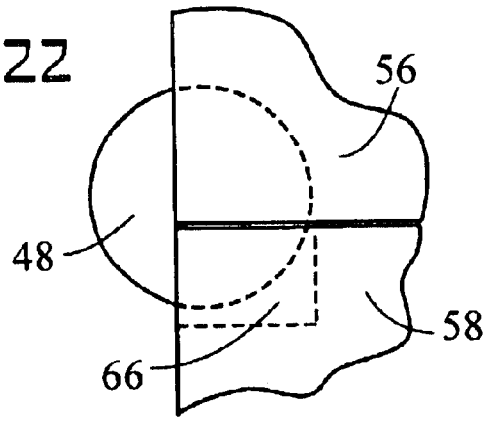
FIG. 22 is an enlarged view of area 22 of FIG. 20.

FIGS. 20 and 21 are reduced first side elevation and first end elevation views, respectively, of first case 40 in an alternate configuration. Top portion 58 has been detached from bottom portion 56. Top portion 58 has been placed upon a support surface 500 with wheel receiving cavity 66 facing upward. Bottom portion 56 has been stacked on top of top portion 58 so that at least one wheel 48 is received by wheel-receiving cavity 66, and bottom portion 58 resides parallel with support surface 500. Were it not for cavity 66, outwardly protruding wheel 48 would cause bottom portion 56 to reside at an angle with respect to support surface 500.

Figure 23:
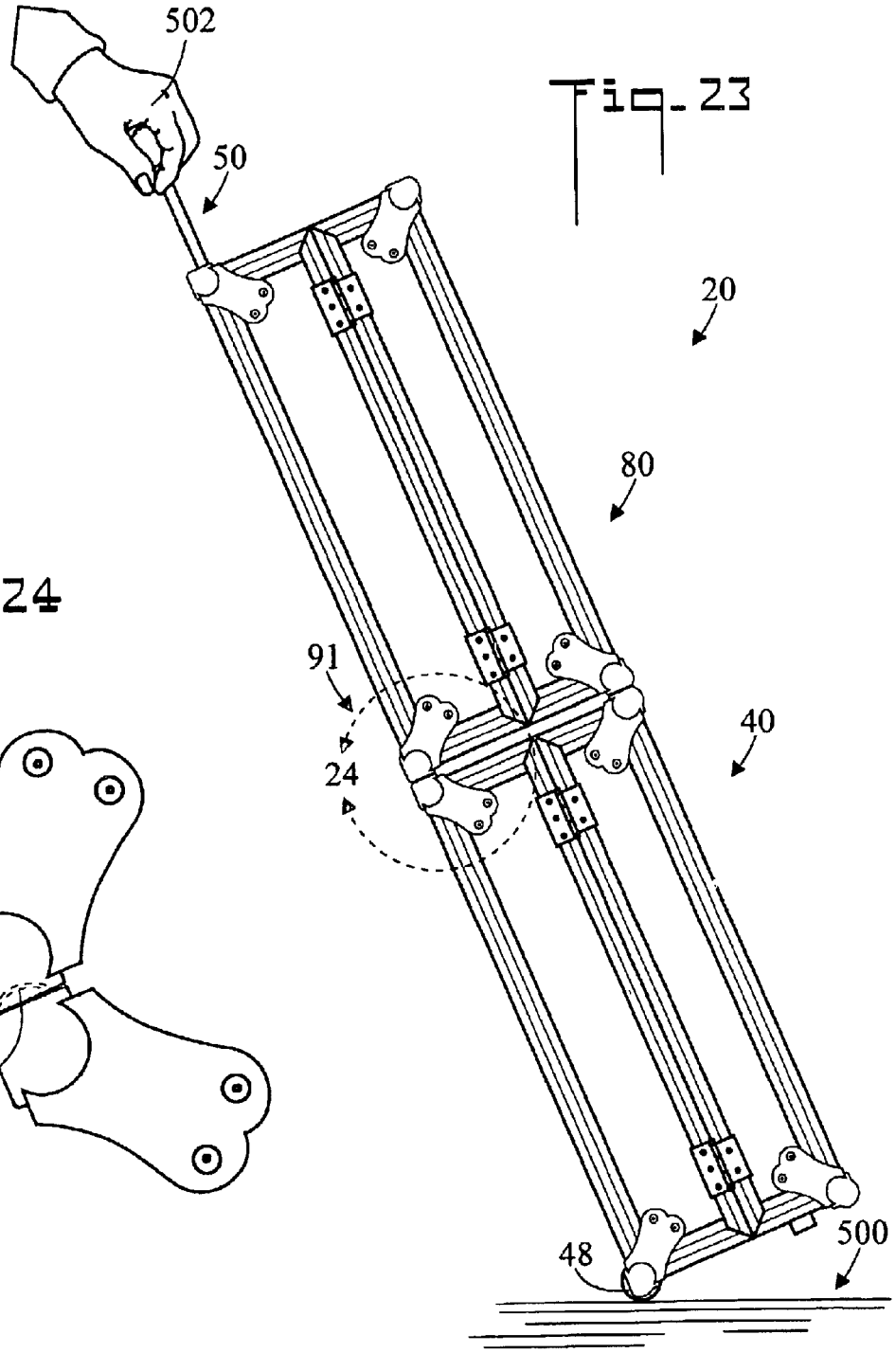
FIG. 23 is a reduced first side elevation view of a second embodiment of the case system; and, FIG. 24 is an enlarged view of area 24 of FIG. 23.
Figure 24:
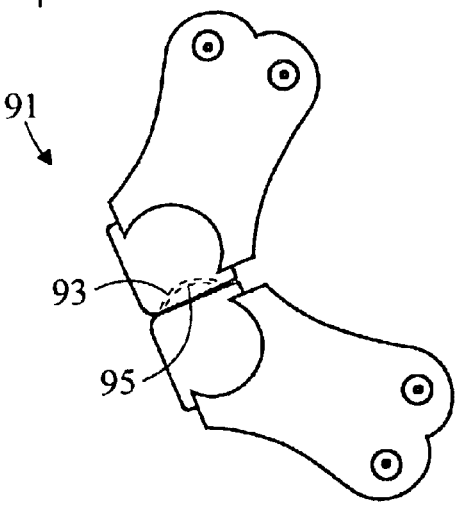

FIG. 23 is a reduced first side elevation view of a second embodiment of case system 20 being pulled by a user 502 by handle 50 on wheels 48 along support surface 500, and FIG. 24 is an enlarged view of area 24 of FIG. 23. In this embodiment, first case 40 and second case 80 have stackable ball corners 91. A ball 95 in one of the first and second cases 40 and 80 engages a socket 93 in the other of the first and second cases 40 and 80 thereby holding the first and second cases 40 and 80 in stacked relationship. In the shown embodiment first case 40 has ball 95 and second case 80 has socket 93.

In terms of use, a method for handling cases, comprises:

(a) providing a first case 40 having:

a bottom 42 having a first edge 44 and an opposite second edge 46;

at least one wheel 48 disposed along first edge 44; and, a handle 50 disposed along second edge 46, wherein handle 50 may be selectively pulled out from a retracted position to an extended position thereby exposing first and second handle shafts 52 and 54;

(b) providing a second case 80 having:

a bottom 82 having first and second spaced apart parallel grooves 84 and 86, grooves 82 and 84 shaped and dimensioned to longitudinally receive first and second handle shafts 52 and 54, respectively;

a first latch 88 which may selectively be activated to capture said first handle shaft 52; and, a second latch 90 which may selectively be activated to capture said second handle shaft 54;

(c) extending handle 50;

(d) ensuring that first and second latches 88 and 90 are not activated;

(e) stacking second case 80 on top of first case 40 so that first groove 84 receives first handle shaft 52 and second groove 86 receives second handle shaft 54; and, (f) activating first and second latches 88 and 90 thereby capturing first and second handle shafts 52 and 54 and retaining second case 80 in fixed relationship with respect to first case 40.

The method further includes:

(g) providing a support surface 500;

(h) tilting first and second cases 40 and 80 so that the cases rest upon the at least one wheel 48; and, (i) using handle 50 to pull first and second cases 40 and 80 along support surface 500.

An alternative method for handling cases, comprises:

(a) providing a first case 40 having:

a bottom portion 56 and a top portion 58 removable from bottom portion 56;

at least one wheel 48 disposed on bottom portion 56;

top portion 58 having an third edge 64;

at least one wheel receiving cavity 66 disposed along third edge 64;

(b) providing a support surface 500;

(c) detaching top portion 58 from bottom portion 56;

(d) placing top portion 58 upon support surface 500 with wheel receiving cavity 66 facing upward; and, (e) stacking bottom portion 56 on top of top portion 58 so that the at least one wheel 48 is received by wheel receiving cavity 66, and bottom portion resides parallel with support surface 500.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A method for handling cases, comprising:

(a) providing a first case having:

a bottom having a first edge and an opposite second edge;

at least one wheel disposed along said first edge;

a handle disposed along said second edge, wherein said handle may be selectively pulled out from a retracted position to an extended position thereby exposing first and second handle shafts;

(b) providing a second case having:

a bottom having first and second spaced apart parallel grooves, said grooves shaped and dimensioned to longitudinally receive said first and second handle shafts respectively;

a first latch which may selectively be activated to capture said first handle shaft;

a second latch which may selectively be activated to capture said second handle shaft;

(c) extending said handle;

(d) ensuring that said first and second latches are not activated;

(e) stacking said second case on top of said first case so that said first groove receives said first handle shaft and said second groove receives said second handle shaft; and, (f) activating said first and second latches thereby capturing said first and second handle shafts and retaining said second case in fixed relationship with respect to said first case.

2. The method according to claim 1, further including:

(g) providing a support surface;

(h) tilting said first and second cases so that said cases rest upon said at least one wheel; and, (i) using said handle to pull said first and second cases along said support surface.

3. The method according to claim 1, further including:

said first and second cases having a stackable ball corner wherein a ball in one of said first and second cases engages a socket in the other of said first and second cases thereby holding said first and second cases in stacked relationship.

4. A method for handling cases, comprising:

(a) providing a first case having:

a bottom portion having a first and second edge and a top portion separable from said bottom portion;

at least one wheel disposed on said bottom portion;

said top portion having a third edge; and, at least one wheel-receiving cavity disposed along said third edge;

(b) providing a support surface;

(c) separating said top portion from said bottom portion;

(d) placing said top portion upon said support surface with said wheel-receiving cavity facing upward;

(e) stacking said bottom portion on top of said top portion so that said at least one wheel is received by said wheel-receiving cavity, and said bottom portion resides parallel with said support surface.

5. A case system for articles, comprising:

a first case having:

a bottom having a first edge and an opposite second edge;

at least one wheel disposed along said first edge; and, a handle disposed along said second edge, wherein said handle may be selectively pulled out from a retracted position to an extended position thereby exposing first and second handle shafts;

a second case having:

a bottom having first and second spaced apart parallel grooves, said grooves shaped and dimensioned to longitudinally receive said first and second handle shafts respectively;

a first latch which may selectively be activated to capture said first handle shaft; and, a second latch which may selectively be activated to capture said second handle shaft; and, so that said handle may be extended, said first and second latches are not activated, said second case is stacked on top of said first case so that said first groove receives said first handle shaft and said second groove receives said second handle shaft, said first and second latches are activated thereby capturing said first and second handle shafts and retaining said second case in fixed relationship with respect to said first case.

6. A case system according to claim 5, further including:

said first case having a bottom portion and a top portion separable from said bottom portion;

said at least one wheel disposed on said bottom portion;

said top portion having a third edge;

at least one wheel-receiving cavity disposed along said third edge; and, wherein when said top portion is detached from said bottom portion, said top portion may be placed upon a support surface with said wheel-receiving cavity facing upward, and said bottom portion stacked on top of said top portion so that said at least one wheel is received by said wheel-receiving cavity, and said bottom portion resides parallel with said support surface.

7. A case system according to claim 5, further including:

said first and second cases having a stackable ball corner wherein a ball in one of said first and second cases engages a socket in the other of said first and second cases thereby holding said first and second cases in stacked relationship.

* * * * *